US008396235B2

(12) United States Patent
Gebhardt et al.

(10) Patent No.: US 8,396,235 B2
(45) Date of Patent: Mar. 12, 2013

(54) HEARING AID WITH INTERFERENCE COMPENSATION AND METHOD FOR CONFIGURATING THE HEARING AID

(75) Inventors: Volker Gebhardt, Neunkirchen am Brand (DE); Peter Nikles, Singapore (SG); Erika Radick, Nürnberg (DE); Gottfried Rückerl, Nürnberg (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 467 days.

(21) Appl. No.: 12/699,189

(22) Filed: Feb. 3, 2010

(65) Prior Publication Data

US 2010/0195857 A1 Aug. 5, 2010

(30) Foreign Application Priority Data

Feb. 3, 2009 (DE) ..... 10 2009 007 233

(51) Int. Cl.
*H04R 25/00* (2006.01)

(52) U.S. Cl. ..... 381/317; 381/312

(58) Field of Classification Search ..... 381/189, 381/315, 331, 317, 312
See application file for complete search history.

(56) References Cited

U.S. PATENT DOCUMENTS

| | | | | |
|---|---|---|---|---|
| 7,198,198 | B2 * | 4/2007 | Akiho et al. | 235/492 |
| 2004/0028251 | A1 * | 2/2004 | Kasztelan et al. | 381/315 |
| 2005/0141742 | A1 * | 6/2005 | Kasztelan | 381/331 |
| 2006/0018495 | A1 * | 1/2006 | Geschiere et al. | 381/189 |
| 2006/0093174 | A1 * | 5/2006 | Niederdrank et al. | 381/317 |
| 2008/0126062 | A1 | 5/2008 | Nikles et al. | |

FOREIGN PATENT DOCUMENTS

| | | | |
|---|---|---|---|
| DE | 19712236 | C1 | 10/1998 |
| DE | 10236940 | B3 | 2/2004 |
| DE | 102004051226 | B3 | 1/2006 |
| EP | 1898673 | A2 | 3/2008 |
| EP | 1915030 | A1 | 4/2008 |

* cited by examiner

*Primary Examiner* — Yuwen Pan
*Assistant Examiner* — Phan Le
(74) *Attorney, Agent, or Firm* — Laurence A. Greenberg; Werner H. Stemer; Ralph E. Locher

(57) ABSTRACT

For reducing the influence of interference fields on hearing aids, a hearing aid is provided with an electronic component into which a first and a second electromagnetic disturbance component can be injected by providing a predetermined electromagnetic interference field. The electrical component is formed asymmetric and/or a compensation component is arranged on the electrical component such that the first and the second interference components largely compensate for one another. A compensation plate or an element which is provided in any case, such as a microphone, may be used as the compensation component. If the electrical component is a coil, then its core may, for example, be conical or configured such that its winding density varies.

16 Claims, 2 Drawing Sheets

HEARING AID WITH INTERFERENCE COMPENSATION AND METHOD FOR CONFIGURATING THE HEARING AID

CROSS-REFERENCE TO RELATED APPLICATION

This application claims the priority, under 35 U.S.C. §119, of German application DE 10 2009 007 233.0, filed Feb. 3, 2009; the prior application is herewith incorporated by reference in its entirety.

BACKGROUND OF THE INVENTION

Field of the Invention

The present invention relates to a hearing aid having an electrical component into which a first and a second electromagnetic interference component can be injected by a predetermined electromagnetic interference field. The present invention furthermore relates to a method for configuring a hearing aid by provision of a virtual electrical component of the hearing aid, simulation of an electromagnetic interference field and determination of a first and a second electromagnetic interference component, which are injected into the virtual electrical component by the electromagnetic interference field. In this case, a hearing aid is any sound-emitting device which can be worn in or on the ear or on the head, in particular a hearing aid, a headset, earphones and the like.

Hearing aids are portable devices which are used for supplying those with hearing impediments. In order to cope with the numerous individual requirements, different forms of hearing aids are provided, such as behind-the-ear hearing aids, hearing aids with an external receiver (RIC: receiver in the channel) and in-the-ear hearing aids, for example including concha hearing aids or channel hearing aids. The hearing aids mentioned by way of example are worn on the external ear or in the auditory channel. Furthermore, bone-conduction hearing aids, implantable hearing aids or vibrotactile hearing aids are also commercially available. In this case, the damaged hearing is stimulated either mechanically or electrically.

In principle, the major components of hearing aids are an input transducer, an amplifier and an output transducer. The input transducer is in general a sound receiver, for example a microphone, and/or an electromagnetic receiver, for example an induction coil. The output transducer is generally an electro-acoustic transducer, for example a miniature loudspeaker, or an electromagnetic transducer, for example a bone conduction receiver. The amplifier is normally integrated in a signal processing unit. This basic configuration is illustrated in FIG. 1, using the example of a behind-the-ear hearing aid. One or more microphones 2 for receiving the sound from the surrounding area are fitted in a hearing aid housing 1 to be worn behind the ear. A signal processing unit 3, which is likewise integrated in the hearing aid housing 1, processes the microphone signals, and amplifies them. The output signal from the signal processing unit 3 is transmitted to a loudspeaker or receiver 4, which emits an acoustic signal. The sound may be transmitted to the eardrum of the hearing-aid wearer via a flexible sound tube which is fixed by an otoplasty in the auditory channel. The power supply for the hearing aid and in particular that for the signal processing unit 3 are provided by a battery 5 which is likewise integrated in the hearing aid housing 1.

Because of the individual anatomy of the ear, the design of in-the-ear hearing aids must be specifically matched to each user. In addition to being responsible for the mechanical matching (design of the individual hearing aid), the production worker is also responsible for acoustic matching (alignment of the receiver in the shell until acoustic feedback is no longer perceptible).

Components which belong to the receiving device of an inductive wireless transmission of data from another hearing aid, a relay station, a programmer or a remote control are integrated on the faceplate and are therefore already physically matched. Since both the maximum transmission power and the reception sensitivity in hearing aids are limited, even very low-power interference sources can have a massive influence on the transmission quality at the receiver because of the low useful signal level that results from this. By way of example, interference sources are the inductances of pulsed voltage regulators, semiconductor components or supply and output lines of virtually all pulsed electronic circuits. The hearing aid receiver is a further interference source in the hearing aid. All physical restrictions (eddy current losses of the battery, hybrid circuit, etc.; interference radiation from lines, hybrid circuit etc.) of the antenna, are held for example, by the fixed position on the faceplate. However, this results in an increase in the minimum required area and the space required on the faceplate. Furthermore, the available space in the auditory channel is frequently not utilized optimally, depending on the individual anatomy of the auditory channels. The fixed position of the components on the faceplate is carried out by hand and in addition involves large inaccuracies relating to the geometric relationships (distances, angles) between the antenna and the interference components, and this must be taken into account in the configuration.

The prior art includes a method for the production of hearing aid shells in which the detailed configuration is carried out on a virtual basis first of all, after scanning the ear print-outs in a computer-aided design process, and the shell can then be mechanically constructed by an SLA machine. The capability to insert components individually into the hearing aid results in a gain in space, thus making it possible to reduce the physical size of the hearing aid.

In order to avoid or reduce interference inputs, it is normal practice to shield the interference source in addition to choosing the greatest possible distance from the interference source. Electrically conductive materials such as μ-metal are generally used for shielding.

A method for reducing interference effects on wireless data transmission in hearing aid applications is known from the subsequently published application with the internal file reference 200808133. In this case, the receiving antenna is manufactured even before assembly of the hearing aid together with the strongest interference source, and matching is carried out by mutual position for minimum interference input.

Furthermore, published, European patent application EP 1 898 673 A2, corresponding to U.S. patent disclosure No. 2008/0126062 describes a computer-aided method for the design of in-the-ear hearing aids. In this case, the hearing aid components are placed on the basis of collision clouds. Each collision cloud in this case represents the extent of the physical influence of one specific characteristic of the component on another component.

SUMMARY OF THE INVENTION

It is accordingly an object of the invention to provide a hearing aid with interference compensation and a method for configuring the hearing aid which overcome the above-mentioned disadvantages of the prior art methods and devices of this general type, which reduces interference inputs to the hearing aid further or in an improved manner.

According to the invention, the object is achieved by a hearing aid having an electrical component into which a first and a second electromagnetic interference component can be injected by a predetermined electromagnetic interference field. The electrical component is asymmetric and/or a compensation component on the electrical component is arranged such that the first and the second interference components largely compensate for one another.

Furthermore, the invention provides a method for configuring a hearing aid by provision of a virtual electrical component of the hearing aid, simulation of an electromagnetic interference field and determination of a first and a second electromagnetic interference component, which are injected into the virtual electrical component by the electromagnetic interference field. The virtual electrical component is asymmetric and/or a virtual compensation component is disposed on the virtual electrical component such that the first and the second interference components compensate for one another.

In an advantageous manner, the hearing aid components are configured such that the electromagnetic interference field acts symmetrically on a component in question, with the injected, symmetrical inference components then largely cancelling one another out. A symmetry of the interference effects is thus in order to reduce the interferences.

The electrical component is preferably an antenna. Antennas are of course, highly sensitive to interference from electromagnetic fields as a result of which interference reduction relating to this has a considerable effect. Furthermore, electrical components or else for example signal lines or other metal components can inadvertently act as an antenna.

In particular, the antenna may be in the form of a coil. If the interference field is asymmetric with respect to the coil, then a plurality of parameters relating to the coil can be varied in order to achieve a symmetrical interference effect in the coil. For example, the winding density, the winding arrangement and/or the core of the coil can preferably be made asymmetric. Completely different parameters which can be varied in order to optimize the interference compensation are then available with regard to the coil.

According to one preferred embodiment, the hearing aid has a predetermined shell for wearing in the auditory channel, wherein the geometry of the shell is taken into account for the design of the electrical component and/or for the arrangement of the compensation component. This allows one individual coil with specific asymmetry to be used, for example, for each individual hearing aid shell.

In a further embodiment, the compensation component has a shielding plate. A shielding plate such as this can be used to effectively vary an interference field.

Alternatively or additionally, the compensation component may have an electronic component. In particular, this makes it possible to also use an electronic component, for example a microphone, which is present in any case in the hearing aid, in the shaping of an interference field.

Other features which are considered as characteristic for the invention are set forth in the appended claims.

Although the invention is illustrated and described herein as embodied in a hearing aid with interference compensation and a method for configuring the hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
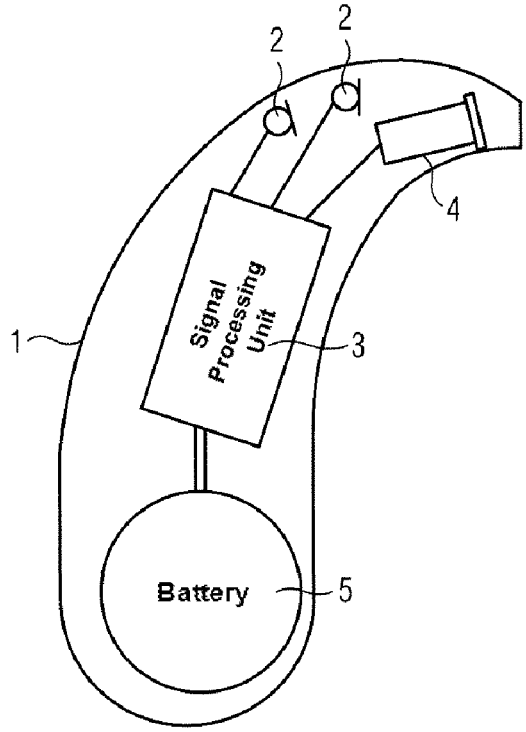
FIG. 1 PRIOR ART
FIG. 1 is a diagrammatic, illustration of a hearing aid according to the prior art.

Exemplary embodiments which will be described in more detail in the following text represent preferred embodiments of the present invention.

When the components are being placed in a hearing aid, the physical restrictions relating to interference injection must be complied with. This can be achieved by what are known as "collision clouds" in design software. These collision clouds are point clouds which are determined by measurements, simulations etc. which are converted to an appropriate file format (STL etc.), and then placed around the virtual component in the design software. No specific other component may enter this cloud when the interference influence is excessive, in order to ensure correct operation. The influences and therefore also the shape and size of the collision clouds can be varied by relative angle changes between components. If an analytical solution exists, it would be feasible to link the design software to simulation software (finite element method, etc.) which simulates electromagnetic interactions, in order to calculate collision clouds in real time. High interference inputs to the individual components (corresponding to large collision clouds) are also predicated on a long distance between the coil and components, in order to ensure that the functionality is still adequate.

The field line profile of the emitted electrical and magnetic interference fields from a component depends on the shape and the material characteristics of the corresponding parts through which current is flowing, or electrically charged parts, and on metallic and/or magnetic components in their vicinity. The interference influence of the magnetic field on the receiving antenna depends on the one hand on the amplitude, and on the other hand on the direction, of the magnetic field with respect to the alignment of the antenna. The shielding methods are often not sufficient in their own right to reduce the amplitude of the interference field at the location of the antenna to a sufficient extent to ensure adequate functionality. The interference input from the magnetic field into the receiving antenna can then be reduced further by using geometric arrangements in which the field lines are injected symmetrically, as a consequence of which the interference currents induced into the coil largely cancel one another out.

The emission characteristics of the individual hearing aid components may be taken into account even in the design software for the virtual design of the hearing aid. The antenna and hearing aid components are placed in a virtual manner such that symmetry effects compensate as well as possible for the interference currents that are induced. Full functionality with a minimal hearing aid form can be achieved by skillful geometric combination of the components.

In order to cope with the inaccuracy resulting from the manual construction in the design of the faceplates, it will be possible to connect the antenna to the optimally aligned interference components (for example a printed circuit board) instead of using shields and/or safety separations (for example a holder). In this case, use is made of the knowledge of the field profiles of the interference source, and a compact position of the components with respect to one another is sought. These two components which are fixed to one another can then be placed as a unit on the faceplate during construction.

In addition to the placing of an existing antenna coil at points where the interference injection is at its lowest, the receiving antenna can, according to the invention, be geometrically matched to the external interference field of the hearing aid components such that the interference currents induced by field injection are compensated for in the antenna. Various coil geometries which can be selected can be made available at this stage in the design software. The interference influence of the components with respect to different coil geometries can be determined computationally and can be visualized using collision clouds. The ideal coil geometry with the smallest possible hearing aid form can thus be used for each individual in-the-ear hearing aid. If an analytical solution exists, it will be possible—as mentioned—to combine the design software with simulation software in order to calculate the respectively ideal coil geometry with the least interference injection, and to transfer the geometric data directly to the production workshops. For example, the simulation software can be used to simulate what interference components will occur when a receiver is operated in an adjacent coil.

A further development of the system would be for the position of the components to be calculated completely automatically. In some design software, a large number of hearing-aid-specific semi-automatic facilities are already possible, such as the placing of the microphones in accordance with acoustic restrictions. If the automatic position were to take account of field inputs of the interference components, the possible coil geometries, all acoustic restrictions, user-specific parameters and all further hearing aid specifications, it will be possible to calculate optimum positions for each individual component. The data can then additionally be used later for automatic positioning during the construction of the hearing aids.

Figure 2:
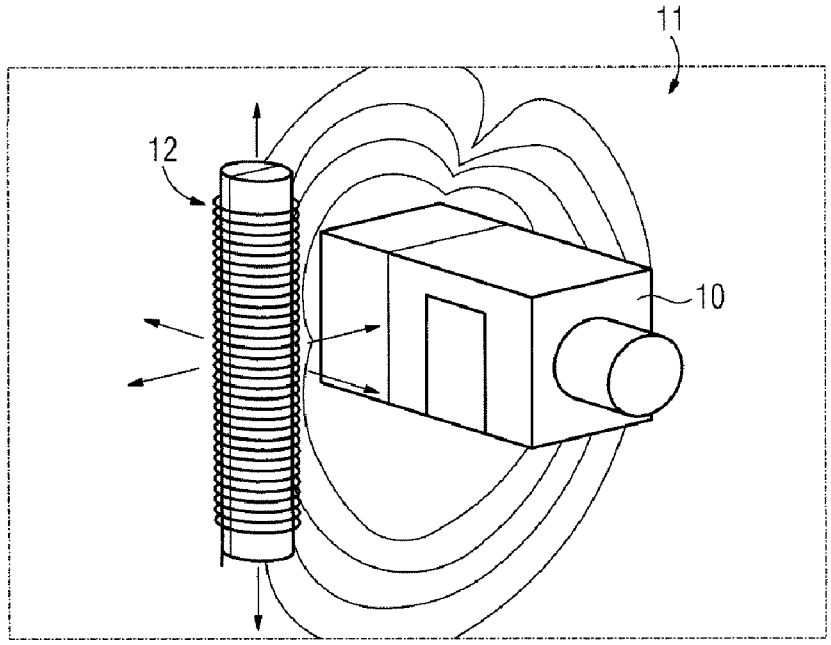
FIG. 2 is a perspective view relating to geometric matching of an interference source and a receiver antenna.
Figure 3:
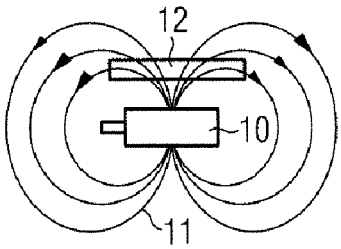
FIG. 3 is an outline sketch relating to symmetrical injection.

In order to better understand exemplary embodiments according to the invention, one known positioning method will first of all be discussed briefly with reference to FIGS. 2 and 3. The receiving antenna is already manufactured together with the strongest interference source during the assembly of the hearing aid, and the mutual position is matched for minimum interference injection. In the example in FIG. 2, a virtual receiver 10 emits a magnetic field 11. The interference source may likewise be, for example a printed circuit board, a hybrid circuit or some other electronic component. The magnetic field 11 causes interference inputs in an electrical component, in this case an adjacent antenna 12. The interference inputs are determined by use of the simulation software. In order to input as little interference as possible, the virtual coil 12 can be moved in all spatial directions, as indicated by the arrows shown.

The matching is preferably carried out by placing the coil at local null points of the electrical and/or magnetic interference field 11 or at positions at which the interference components and induced interference currents are compensated for by the input being symmetrical. The input into the antenna or coil 12 is recorded by measurement. The position of the antenna is optimized until the minimum input is achieved. The resultant position of the antenna with respect to the interference source is then permanently fixed by suitable measures (adhesive, holder). The antenna/interference source combination can then be incorporated in manufacture as a single component optimized for minimum interference injection. Both the quality and the manufacturing yield can thus be improved.

During the virtual design of the hearing aid using the design software, the receiving coil 12 can be placed at local null points of the electrical and/or magnetic interference field or at positions in which the induced interference currents are compensated for by the input being symmetrical. The input into the antenna is visualized by collision clouds or calculated by simulation software which is connected to design and software. The geometric matching between the receiving coil 12 and the interference source (receiver 10) illustrated in FIG. 2 can be optimized using the design software until the minimum interference input is achieved. This allows the full functionality to be achieved with a minimum hearing aid physical form.

Figure 4:
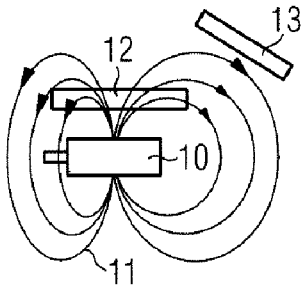
FIG. 4 is a sketch relating to asymmetric "field bending" by metallization of a printed circuit board.
Figure 5:
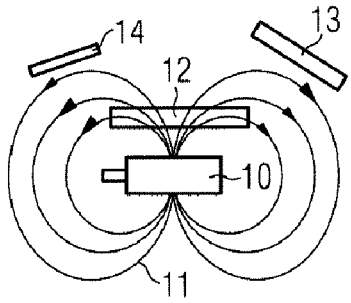
FIG. 5 is a sketch relating to compensation according to the invention for the field asymmetry by a metal plate.
Figure 6:
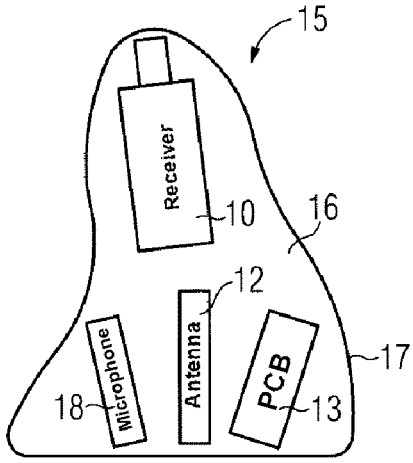
FIG. 6 is an illustration showing the use of hearing aid components in order to compensate for the asymmetry of the interference field injection.

The presence of other electrical and magnetic components in the hearing aid leads to field bending or distortion of the interference field. On the one hand, the local null points of the electrical and/or magnetic interference field are shifted or are lost as a result. On the other hand, the bending of the field lines lead to the input into the receiving antenna being asymmetric. In both cases, the interference input into the receiving antenna rises, since the interference components are asymmetric. The interference influence can be reduced by introduction of additional compensation plates with metallic or magnetic characteristics, which correct this field bending. This will be explained in more detail in conjunction with FIGS. 3 to 5. First of all, FIG. 3 illustrates the case in which the receiver 10 produces a symmetrical magnetic interference field 11. The antenna 12 is located in the interference field 11 so as to achieve symmetrical inputs. In particular, the antenna 12 is in this case arranged symmetrically with respect to the axis resulting from the alignment of the magnet in the receiver 10. As shown in FIG. 4, the interference field 11 of the receiver 10 in the hearing aid is now deformed by a printed circuit board 13 with metallization in such a way that the interference influence in the antenna 12 rises, because the input is asymmetric. Additional use of a thin metallic compensation plate 14 compensates for the field deformation as shown in FIG. 5. The input into the antenna 12 is therefore once again symmetrical (the left-hand and right-hand interference components have the same magnitude), and the induced interference currents compensate for one another. The position and geometry of the compensation plate 14 or of the compensation plates can be calculated quickly by the simulation software for the electromagnetic input, which is linked to the design software. For miniaturization purposes, suitable already-existing metallic and/or magnetic hearing aid components (for example microphone, shielding plate) can also be used to compensate for the field asymmetry, instead of using a compensation plate. In the example in FIG. 6, compensation such as this is provided in an in-the-ear hearing aid 15.

The in-the-ear hearing aid 15 has an individually shaped hearing aid shell 16 which is closed by a faceplate 17. The components of the example in FIG. 4 are arranged in the hearing aid, specifically a receiver 10, an antenna 12 and a printed circuit board 13. Furthermore, a microphone 18 is located at a position in the in-the-ear hearing aid 15 which shapes the magnetic field emitted from the receiver 10 so as to compensate for the interference currents induced in the antenna 12. This influencing of the field by the microphone makes it possible to avoid an additional component (such as the compensation plate 14 in FIG. 5), and allows the small amount of available space in the hearing aid to be used optimally for other hearing aid components.

The interference injected into the receiving antenna 12 by the magnetic field can be reduced further by using geometric arrangements in which the field lines are input symmetrically and the interference currents induced in the coil largely cancel one another out. The emission characteristics of the individual hearing aid components can actually be taken into account during the virtual design of the hearing aid in the design software. The antenna and the hearing aid components are in this case placed virtually so as to compensate as well as possible for the induced interference currents, on the basis of symmetry effects. Complete functionality can be achieved with a minimum hearing aid physical size by skillful geometric combination of the components.

Furthermore, the optimally aligned connection between the antenna 12 and an interference component (sensibly the component with the greatest interference potential) would on the one hand improve the quality of the faceplate 17 and on the other hand would assist the process of making the design more compact, and therefore in making the final hearing aids smaller.

Figure 7:
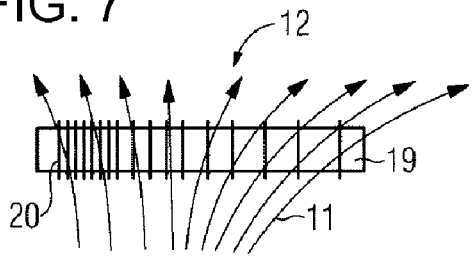
FIG. 7 is an illustration showing a variation of a winding density of an antenna in an inhomogeneous interference field.
Figure 8:
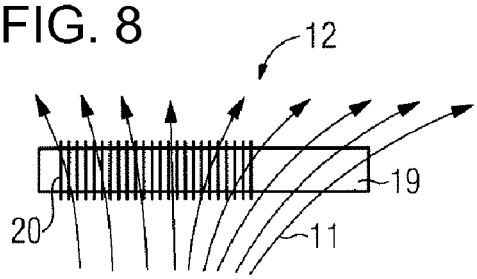
FIG. 8 is an illustration showing an asymmetric winding of the antenna in the inhomogeneous interference field.
Figure 9:
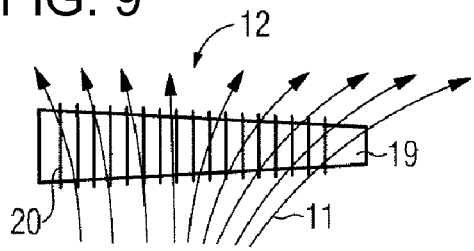
FIG. 9 is an illustration showing an asymmetric coil core of the antenna in the inhomogeneous interference field.
Figure 10:
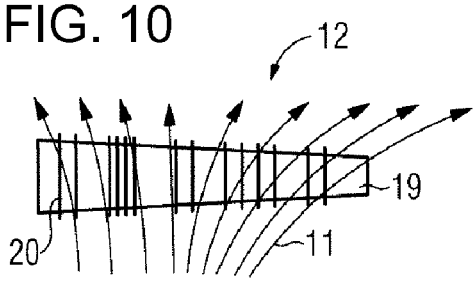
FIG. 10 is an illustration showing a combination of core and winding asymmetry of the antenna in the inhomogeneous interference field.

Furthermore, the receiving antenna 12 can itself be geometrically designed such that, if the interference field 11 is asymmetric, the resultant induced interference currents in the antenna are compensated for. Exemplary embodiments relating to this are illustrated in FIGS. 7 to 10. Specifically, FIG. 7 shows a coil antenna 12 which has a cylindrical core 19 and turns 20. The density of the turns, that is to say the winding density on the core 19 decreases to the right in FIG. 7. The interference field 11 has a corresponding field gradient in the coil direction. This means that the influence of the interference field 11 is less in the left-hand part of the coil than in the right-hand part of the coil. In order to achieve symmetrical interference current components, the winding density in the right-hand part of the coil is therefore less than that in the left-hand part. The same compensation effect can be achieved by arranging the winding 20 asymmetrically on the core 19, as shown in FIG. 8. Specifically, the turns 20 are arranged on the left-hand side of the core 19, but not on the right-hand side. The severe interference influence of the interference field 11 on the right-hand side therefore has less effect, and its effect is approximately as great as the influence on the left-hand side. Symmetrical interference components in an inhomogeneous interference field 11 may be obtained, as shown in FIG. 9, by designing the coil core 19 to be asymmetric. In the present example, the core 19 is conical. In principle, the measures shown in FIGS. 7 to 9 can also be combined in order to compensate for the interference components of an interference field. By way of example, the conical core 19 may be provided with an asymmetric winding, in order to compensate for the various directional interference components, as is shown in FIG. 10. Different coil geometries may be made available in the design software itself, and are then selected as required. The interference influence of the components with respect to different coil geometries can be visualized using collision clouds, and the ideal coil geometry can be used for the production with an individual shell, in order to achieve a hearing aid form which is as small as possible.

Further, the design software can be linked to the simulation software for the electromagnetic injection in order to calculate the respective ideal coil geometry with the minimum possible interference injection, depending on the position of the other currents of a hearing aid. It is therefore possible to find a hearing aid shell with the ideal combination of geometric arrangement of the hearing aid components and antenna coil for each individual anatomy of the ear.

Complex operating instructions are no longer required, because the physical restrictions have been displaced into the design software. The construction of the hearing aids can be calculated accurately in time, as there is no need for trial and error techniques and repeated opening and closing of the hearing aid, and this makes it possible not only to calculate but also to improve the product quality. One major advantage of the use of the proposed methods is that all the components can be placed individually. The specifically available space (depending on the ear channel geometry) can thus be utilized better, and this in turn leads to smaller in-the-ear hearing aids which are also more advantageous from the cosmetic point of view. Furthermore, more complex technologies, which until now have been virtually impossible to use for mass production, may be used for in-the-ear hearing aids. The collision cloud method allows automatic placing to be programmed more easily, and requires less computation power.

The invention claimed is:

1. A hearing aid, comprising:

an electrical component into which a first component of an electromagnetic interference and a second component of the electromagnetic interference can be injected by means of a predetermined electromagnetic interference field, said electrical component is asymmetric such that the first component of the electromagnetic interference and the second component of the electromagnetic interference significantly compensate for one another, wherein the first component of the electromagnetic interference and the second component of the electromagnetic interference are asymmetric to one another in relation to said electrical component; and a compensation component disposed on said electrical component such that the first component of the electromagnetic interference and the second component of the electromagnetic interference significantly compensate for one another.

2. The hearing aid according to claim 1, wherein said electrical component is an antenna.

3. The hearing aid according to claim 2, wherein said antenna is formed by a coil.

4. The hearing aid according to claim 3, wherein said coil has an asymmetric winding density.

5. The hearing aid according to claim 3, wherein said coil has an asymmetric winding configuration.

6. The hearing aid according to claim 3, wherein said coil has an asymmetric core.

7. The hearing aid according to claim 1, further comprising a predetermined shell for wearing in an auditory channel, a geometry of said predetermined shell is taken into account for a design of at least one of said electrical component and for an arrangement of said compensation component.

8. The hearing aid according to claim 1, wherein said compensation component has a shielding plate.

9. The hearing aid according to claim 1, wherein said compensation component has a further electronic component.

10. A hearing aid, comprising:

an electrical component into which a first component of an electromagnetic interference and a second component of the electromagnetic interference can be injected by means of a predetermined electromagnetic interference field, said electrical component is asymmetric such that the first component of the electromagnetic interference and the second component of the electromagnetic interference significantly compensate for one another, wherein the first component of the electromagnetic interference and the second component of the electromagnetic interference are asymmetric to one another in relation to said electrical component.

11. A hearing aid, comprising:

an electrical component into which a first component of electromagnetic interference and a second component of the electromagnetic interference can be injected by means of a predetermined electromagnetic interference field; and a compensation component disposed on said electrical component to distort the predetermined electromagnetic interference field such that the first component of the electromagnetic interference and the second component of the electromagnetic interference are significantly symmetric in relation to said electrical component, said compensation component disposed on said electrical component such that the first component of the electromagnetic interference and the second component of the electromagnetic interference significantly compensate for one another.

12. A method for designing a hearing aid, which comprises the steps of:

providing a virtual electrical component on the hearing aid;

simulating an electromagnetic interference field;

determining a first component of an electromagnetic interference and a second component of the electromagnetic interference, which are injected into the virtual electrical component by means of the electromagnetic interference field;

forming the virtual electrical component to be asymmetric with respect to the first component of the electromagnetic interference and the second component of the electromagnetic interference such that the first component of the electromagnetic interference and the second component of the electromagnetic interference compensate for one another; and disposing a virtual compensation component on the virtual electrical component such that the first component of the electromagnetic interference and the second component of the electromagnetic interference compensate for one another.

13. The method according to claim 12, which further comprises forming the virtual electrical component as a virtual coil and the virtual coil has at least one of an asymmetric winding density, an asymmetric winding configuration and an asymmetric core.

14. The method according to claim 12, wherein a virtual shell is specified for the hearing aid to be worn in an auditory channel and a geometry of the virtual shell is taken into account for at least one of a design of the virtual electronic component and for an arrangement of the virtual compensation component.

15. A method for designing a hearing aid, which comprises the steps of:

providing a virtual electrical component on the hearing aid;

simulating an electromagnetic interference field;

determining a first component of an electromagnetic interference and a second component of the electromagnetic interference, which are injected into the virtual electrical component by means of the electromagnetic interference field; and forming the virtual electrical component to be asymmetric with respect to the first component of the electromagnetic interference and the second component of the electromagnetic interference such that the first component of the electromagnetic interference and the second component of the electromagnetic interference compensate for one another.

16. A method for designing a hearing aid, which comprises the steps of:

providing a virtual electrical component on the hearing aid;

simulating an electromagnetic interference field;

determining a first component of an electromagnetic interference and a second component of the electromagnetic interference, which are injected into the virtual electrical component by means of the electromagnetic interference field; and disposing a virtual compensation component on the virtual electrical component to distort the electromagnetic interference field such that the first component of the electromagnetic interference and the second component of the electromagnetic interference are significantly symmetric in relation to the virtual electrical component, and disposing the virtual compensation on the virtual electrical component such that the first component of the electromagnetic interference and the second component of the electromagnetic interference compensate for one another.

* * * * *